US010950939B2

(12) United States Patent
West

(10) Patent No.: US 10,950,939 B2
(45) Date of Patent: Mar. 16, 2021

(54) SYSTEMS AND METHODS FOR ULTRA-ULTRA-WIDE BAND AESA

(71) Applicant: Rockwell Collins, Inc., Cedar Rapids, IA (US)

(72) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 22 days.

(21) Appl. No.: 16/291,811

(22) Filed: Mar. 4, 2019

(65) Prior Publication Data

US 2020/0185830 A1 Jun. 11, 2020

Related U.S. Application Data

(63) Continuation of application No. 15/160,959, filed on May 20, 2016, now Pat. No. 10,224,629.

(51) Int. Cl.
*H01Q 3/26* (2006.01)
*H01Q 21/06* (2006.01)
(Continued)

(52) U.S. Cl.
CPC ..... *H01Q 3/2682* (2013.01); *H01Q 21/0025* (2013.01); *H01Q 21/062* (2013.01); *H01Q 21/20* (2013.01); *H01Q 1/286* (2013.01)

(58) Field of Classification Search
CPC .. H01Q 1/286; H01Q 3/2682; H01Q 21/0025; H01Q 21/062; H01Q 21/20
See application file for complete search history.

(56) References Cited

U.S. PATENT DOCUMENTS 6,483,481 B1 * 11/2002 Sievenpiper ..... H01Q 15/008 343/700 MS
2004/0263420 A1 * 12/2004 Werner ..... H01Q 17/00 343/909

(Continued)

FOREIGN PATENT DOCUMENTS

CN 103762425 A 4/2014
EP 2 228 864 9/2010

(Continued)

OTHER PUBLICATIONS

Cantrell et al., "Wideband Array Antenna Concept", 2005 IEEE. 5 pages.

(Continued)

*Primary Examiner* — Dao L Phan
(74) *Attorney, Agent, or Firm* — Suiter Swantz pc llo

(57) ABSTRACT

In one aspect, the inventive concepts disclosed herein are directed to an antenna array system employing a current sheet array (CSA) wavelength scaled aperture. The CSA wavelength scaled aperture can include a first frequency region associated with a first operating frequency band and a second frequency region associated with a second operating frequency band. The first operating frequency band can include one or more current sheet sub-arrays having a respective plurality of first unit cells scaled to support the first operating frequency band. The second operating frequency band can include one or more current sheet sub-arrays having a respective plurality of second unit cells scaled to support the second operating frequency band. The CSA wavelength scaled aperture can include one or more capacitors each of which coupled to a respective first unit cell of the first frequency region and a respective second unit cell of the second frequency region.

20 Claims, 4 Drawing Sheets

(51) Int. Cl.

| | |
|---|---|
| ***H01Q 21/20*** | (2006.01) |
| ***H01Q 21/00*** | (2006.01) |
| *H01Q 1/28* | (2006.01) |

(56) References Cited

U.S. PATENT DOCUMENTS

| | | | | |
|---|---|---|---|---|
| 2008/0062062 | A1 | 3/2008 | Borau et al. | |
| 2009/0231226 | A1* | 9/2009 | Quan | H01Q 5/42 343/770 |
| 2010/0073233 | A1 | 3/2010 | Young et al. | |
| 2019/0237873 | A1* | 8/2019 | Sazegar | H01Q 3/40 |

FOREIGN PATENT DOCUMENTS

| | | | |
|---|---|---|---|
| EP | 2 230 775 | | 9/2010 |
| WO | WO-2006/024516 | A1 | 3/2006 |

OTHER PUBLICATIONS

Kindt, Rick et al., "A Wavelength-Scaled Ultra-Wide Bandwidth Array", IEEE Xplore, downloaded on Dec. 21, 2009, 4 pages.

Non-Final Office Action for U.S. Appl. No. 15/160,959 dated May 31, 2018.

Notice of Allowance for U.S. Appl. No. 15/160,959 dated Oct. 24, 2018.

First Office Action for Chinese Patent Application No. 201610958098.0, dated May 7, 2019. 5 pages.

Kindt, Rick W., "Prototype Design of a Modular Ultrawideband Wavelength-Scaled Array of Flared Notches", IEEE Transactions on Antennas and Propagation, vol. 60, No. 3, Mar. 2012. 9 pages.

Jones et al., "A New Approach to Broadband Array Design Using Tightly Coupled Elements", IEEE 2007, 7 pages.

* cited by examiner

SYSTEMS AND METHODS FOR ULTRA-ULTRA-WIDE BAND AESA

RELATED APPLICATIONS

This application is a continuation of U.S. patent application Ser. No. 15/160,959 filed on May 20, 2016, and entitled "SYSTEMS AND METHODS FOR ULTRA-ULTRA-WIDE BAND AESA", which is incorporated herein by reference in its entirety.

BACKGROUND

Active electronically scanned array (AESA) systems provide reliable performance over respective ultra-wide bands (UWBs) of operating frequencies. AESA systems are commonly used in communication systems, military and weather radar systems, electronic intelligence systems, or biological or medical microwave imaging systems. An AESA system makes use of an array of radiating elements (or antenna elements) steerable via a respective group of transmit/receive modules (TRMs). By independently steering each of its antenna elements, an AESA system provides a relatively high reception/transmission performance through constructive accumulation of signals associated with a plurality of antenna elements. Also, because of the inherent capability to simultaneously use, and independently steer, a respective plurality of antenna elements, the single failures of one or few antenna elements within an AESA system have little effect on the operation of the AESA system as a whole. Furthermore, AESA systems are difficult to jam because of their capability to hop from one operational frequency to another within the respective UWB.

Existing AESA systems, however, suffer from various limitations. For example, many AESA systems are characterized with thick apertures. For example, in typical Vivaldi apertures, the length of the antenna elements is about four times the wavelength at the highest supported frequency. Such thickness imposes constraints on the space needed to mount a Vivaldi AESA system on a deployment platform. Also, the printed circuit board (PCB) technology employed in constructing many AESA apertures impose a limit on the maximum instantaneous bandwidth (IBW) achievable. Furthermore, existing AESA aperture topologies may not provide enough topological flexibility to conform with curved deployment platform surfaces. In particular, most existing AESA apertures have planar configurations. In addition, most existing AESA aperture architectures are not easily scalable. This deficiency in scalability increases the complexity and cost of constructing make large AESA apertures.

The limitations of existing AESA systems can hinder possibilities of expanding the use of AESA systems in new communication, military, or sensing systems requiring wider frequency bands than typical UWBs supported by existing AESA systems, or requiring large and/or non-planar apertures. Overcoming such limitations would support such new systems and can allow for reduced cost AESA apertures.

SUMMARY

In one aspect, the inventive concepts disclosed herein are directed to an antenna array system comprising a high frequency sub-array including a plurality of first unit cells scaled to support a first operating frequency band having a respective maximum operating frequency f1. The first operating frequency band represents a full operating frequency band of the antenna array system. The antenna array system can also include a plurality of medium frequency sub-arrays arranged around the high frequency sub-array. Each medium frequency sub-array can include a plurality of second unit cells scaled to support a second operating frequency having a respective maximum operating frequency f2 smaller than f1. The antenna array system can also include one or more first capacitors each of which coupled to a respective first unit cell of the high frequency sub-array and a respective second unit cell of the plurality of medium frequency sub-arrays. The antenna array system can also include a plurality of low frequency sub-arrays arranged around the plurality of medium frequency sub-arrays. Each low frequency sub-array can include a plurality of third unit cells scaled to support a third operating frequency having a respective highest frequency f3 smaller than f2. The antenna array system can also include one or more second capacitors each of which coupled to a respective second unit cell of the plurality of medium frequency sub-arrays and a respective third unit cell of the plurality of low frequency sub-arrays. The antenna array system can also include a processor for controlling operational parameters associated with the plurality of first unit cells, plurality of second unit cells, and the plurality of third unit cells.

In some embodiments, the antenna array system can further comprise a plurality of transmit/receive modules (TRMs). Each TRM can be associated with a respective first unit cell, a respective second unit cell, or a respective third unit cell. In some embodiments, the antenna array system can also comprise a plurality of time delay units where each time delay unit can be associated with a respective first unit cell, a respective second unit cell, or a respective third unit cell. In some embodiments, the high frequency sub-array, each of the plurality of medium frequency sub-arrays, and each of the plurality of low frequency sub-arrays can be associated with a separate printed circuit board (PCB). In some embodiments, the processor can be configured to activate at least one of the high frequency sub-array, the plurality of medium frequency sub-arrays, and the plurality of low frequency sub-arrays for receiving or transmitting a radio signal.

In some embodiments, the high frequency sub-array, the plurality of medium frequency sub-arrays, and the plurality of low frequency sub-arrays can be arranged according to a non-planar configuration. In some embodiments, the one or more first capacitors and the one or more second capacitors can be non-planar capacitors. In some embodiments, the one or more first capacitors or the one or more second capacitors can be interdigitated capacitors. In some embodiments, the one or more first capacitors or the one or more second capacitors can be active electronic variable capacitors.

In some embodiments, the one or more first capacitors include a lumped passive capacitor metallurgically coupled to the respective first unit cell and the respective second unit cell. In some embodiments, the one or more second capacitors include a lumped passive capacitor metallurgically coupled to the respective second unit cell and the respective third unit cell. In some embodiments, the plurality of first unit cells, the plurality of second unit cells, and the plurality of third unit cells include crossed dipoles.

In a further aspect, the inventive concepts disclosed herein are directed to a current sheet array (CSA) wavelength scaled antenna aperture comprising a high frequency sub-array including a plurality of first unit cells scaled to support a first operating frequency band having a respective maximum operating frequency f1. The first operating frequency band represents a full operating frequency band of the CSA wavelength scaled antenna aperture. The CSA wavelength scaled antenna aperture can also include a plurality of medium frequency sub-arrays arranged around the high frequency sub-array. Each medium frequency sub-array can include a plurality of second unit cells scaled to support a second operating frequency having a respective maximum operating frequency f2 smaller than f1. The CSA wavelength scaled antenna aperture can also include one or more first capacitors each of which coupled to a respective first unit cell of the high frequency sub-array and a respective second unit cell of the plurality of medium frequency sub-arrays. The CSA wavelength scaled antenna aperture can also include a plurality of low frequency sub-arrays arranged around the plurality of medium frequency sub-arrays. Each low frequency sub-array can include a plurality of third unit cells scaled to support a third operating frequency having a respective highest frequency f3 smaller than f2. The CSA wavelength scaled antenna aperture can also include one or more second capacitors each of which coupled to a respective second unit cell of the plurality of medium frequency sub-arrays and a respective third unit cell of the plurality of low frequency sub-arrays.

In some embodiments, the high frequency sub-array, the plurality of medium frequency sub-arrays, and the plurality of low frequency sub-arrays can be arranged according to a non-planar configuration. In some embodiments, the one or more first capacitors and the one or more second capacitors can be non-planar capacitors. In some embodiments, the one or more first capacitors or the one or more second capacitors can be interdigitated capacitors. In some embodiments, the one or more first capacitors or the one or more second capacitors can be active electronic variable capacitors.

In some embodiments, the one or more first capacitors include a lumped passive capacitor metallurgically coupled to the respective first unit cell and the respective second unit cell. In some embodiments, the one or more second capacitors include a lumped passive capacitor metallurgically coupled to the respective second unit cell and the respective third unit cell. In some embodiments, the plurality of first unit cells, the plurality of second unit cells, and the plurality of third unit cells include crossed dipoles.

BRIEF DESCRIPTION OF THE DRAWINGS

Embodiments of the inventive concepts disclosed herein will become more fully understood from the following detailed description, taken in conjunction with the accompanying drawings, wherein like reference numerals refer to like elements, in which.

DETAILED DESCRIPTION

Figure 1:
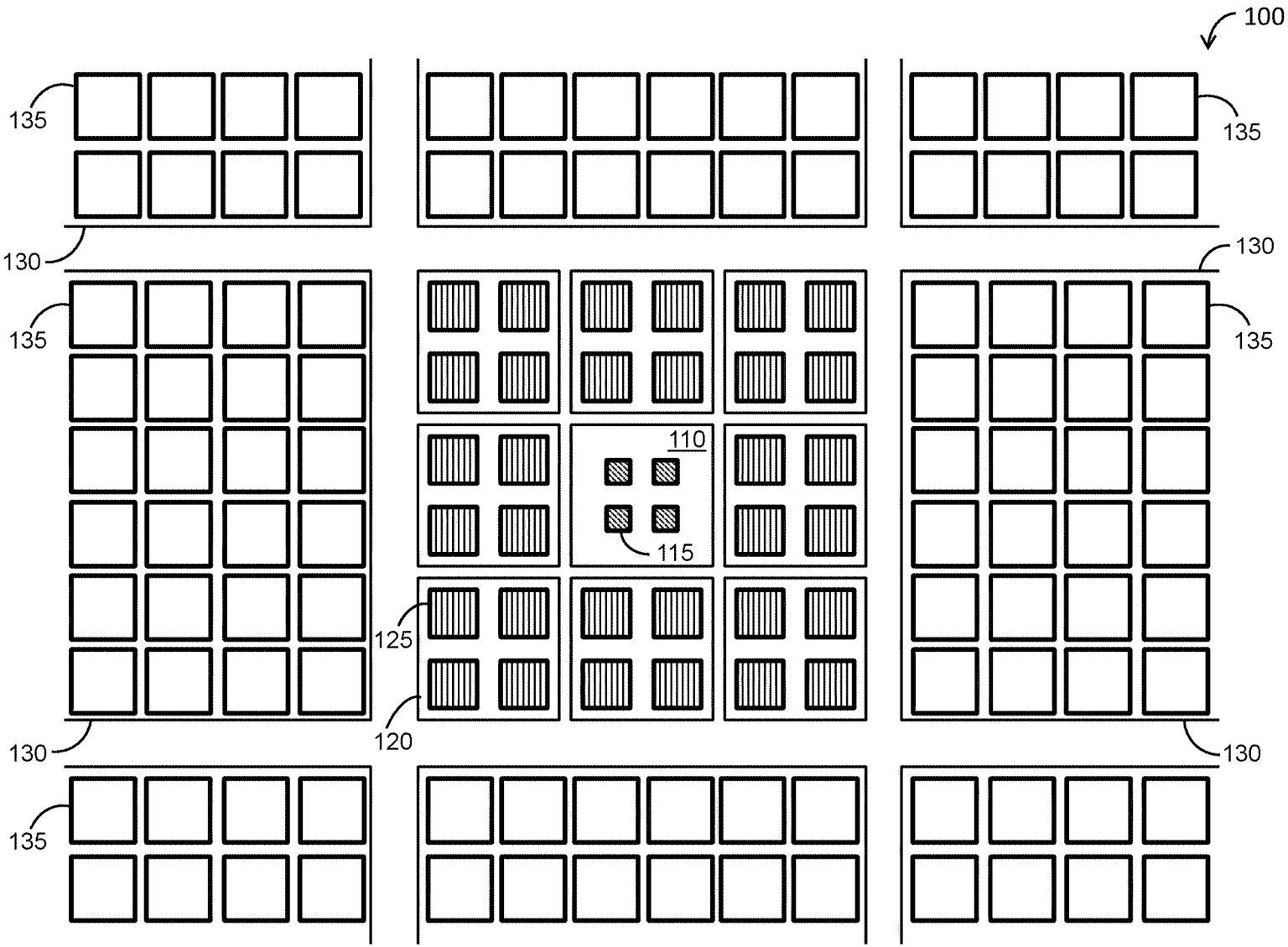
FIG. 1 is a block diagram of a current sheet array (CSA) wavelength scaled aperture in accordance with some embodiments of the inventive concepts disclosed herein.

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the schematic diagrams, but should be construed in accordance with the language in the claims.

Active electronically-scanned array (AESA) antenna systems are used in communication systems, satellite communications (SatCom) systems, sensing and/or radar systems (such as military radar systems or weather radar systems), electronic intelligence (ELINT) receivers, electronic counter measure (ECM) systems, electronic support measure (ESM) systems, targeting systems, or biological or medical microwave imaging systems. AESA antenna systems provide, in many applications, reliable ultra-wide band (UWB) performance. However, recently there has been a need for more advanced AESA antenna systems. For instance, next generation military/intelligence multimode systems pose substantial challenges and requirements for contemporary UWB AESA technologies. These military/intelligence multimode systems call for low profile ultra-ultra-wide band ($U^2WB$) technology that supports arbitrary polarization and an instantaneous bandwidth (IBW) of greater than or equal to 20:1 within a frequency range of interest extending from 200 MHz to 60 GHz. The new generation military/intelligence multimode systems also call for an aperture architecture that is scalable to arbitrarily large AESA apertures without grating lobes. Also, aperture configuration conformity to arbitrary curved surfaces allows for easy mounting the AESA aperture aircraft fuselage or respective wing leading edge, missile fuselage or respective nose cone, ground vehicle, and/or other platforms.

Existing UWB apertures fail to satisfy the desired features mentioned above. For example, classic Vivaldi apertures are usually thick and as such do not satisfy the low profile characteristic. Also, such apertures usually suffer from high cross-polarization within inter-cardinal planes. With regard to Balanced Antipodal Vivaldi Antenna (BAVA), the respective IBW is restricted to 10:1 and does satisfy the characteristic of an IBW greater than or equal to 20:1. In addition, the genetic algorithm-based fragmented array technology involves the use of an excessively complicated feed manifold/time delay beam former architecture.

Current sheet array (CSA) technology allows for low profile aperture topology. A classical CSA aperture includes an array of tightly coupled identical unit cells (or elements), such as a tightly coupled dipole array (TCDA). The dimension(s) of the unit cells of a CSA aperture usually define the shortest wavelength or the highest frequency supported by the array. Also, the aperture lattice spacing (e.g., spacing between adjacent cell units) in a classical CSA aperture is usually set to half the shortest supported wavelength to prevent introducing grating lobes within the visible space across the IBW. Such configuration results in excessive redundancy and an unnecessarily large number of antenna elements and transmit/receive modules, which in turn increase the cost and complexity CSA based AESA systems. Also, the large number of antenna elements and transmit/receive modules can lead to high radio frequency (RF) interconnect density and therefore reduced reliability. Furthermore, classical CSA apertures suffer from low efficiency within certain sub-regions of the IBW, and frequency band constraints, for example, imposed by printed circuit board (PCB) manufacturing processes.

Inventive concepts described herein introduce low profile ultra-ultra-wide band ($U^2WB$) current sheet array (CSA) wavelength scaled apertures for use in AESA systems. The CSA wavelength scaled apertures employ modular sub-array architecture. In particular, a CSA wavelength scaled aperture includes two or more frequency regions. Each frequency region can be associated with a respective frequency band, and can include one or more sub-arrays of antenna elements scaled to support the frequency band associated with that frequency region. Antenna elements within a given sub-array or across different subarrays can be coupled to each other via capacitors. The modular sub-array architecture allows for scaling CSA wavelength scaled apertures to desired AESA apertures. Also, the various sub-arrays, or the various frequency regions can be arranged according to a non-planar configuration to allow surface/contour conformal attachment to vehicular platform surfaces, such as aircraft fuselages, for example.

The CSA wavelength scaled apertures allow for increased IBW and a wide scan volume without grating lobes. Also, the CSA wavelength scaled apertures allow for spectrum efficiency and dynamic spectrum allocation to enhance immunity against ambiguous attacks or threats in commercial systems and military systems. The CSA wavelength scaled apertures described herein can be employed in military applications as well as commercial applications, such as satellite communications, weather radars, data link, avionics RF sensor suites for commercial aircrafts, common aperture for low weight and aerodynamic drag (e.g., for aircraft fuel savings and improved dispatchability).

With reference to FIG. 1, a current sheet array (CSA) wavelength scaled aperture (WSA) 100 includes a high frequency sub-array 110, a plurality of medium frequency sub-arrays 120, and a plurality of low frequency sub-arrays 130. The high frequency sub-array 110 includes a plurality of respective high frequency unit cells (or high frequency antennal elements) 115. Each of the medium frequency sub-arrays 120 includes a plurality of respective medium frequency unit cells (or medium frequency antennal elements) 125. Each of the low frequency sub-arrays 130 includes a plurality of respective low frequency unit cells (or low frequency antennal elements) 135. While the CSA wavelength scaled aperture 100 of FIG. 1 includes a single high frequency sub-array 110, in more general embodiments, the CSA wavelength scaled aperture 100 can include any number of high frequency sub-array 110.

The CSA wavelength scaled aperture 100 includes three endocentric regions of unit cells; a high frequency region, a medium frequency region, and a low frequency region. Each of array regions is associated with a respective supported bandwidth. The high frequency region can include at least one current sheet high frequency sub-array 110. Each high frequency current sheet sub-array 110 includes a plurality of high frequency unit cells (or high frequency antenna elements) 115. The high frequency unit cells 115 of the high frequency region can be of equal size or identical. For instance, a dimension (e.g., width, length, or other dimension) of the high frequency unit cells 115 can be equal to (or slightly larger than)

$$\frac{\lambda_{high}}{2}.$$

The parameter $\lambda_{high}$ represents the shortest wavelength supported by the high frequency region and by the CSA wavelength scaled aperture 100 as a whole. The wavelength $\lambda_{high}$ corresponds to the highest frequency $f_{high}$ supported by the high frequency region. As such, the highest frequency region (or the high frequency sub-array(s) 110) supports a frequency bandwidth $[f_0, f_{high}]$, where $f_0$ represents the lowest frequency supported by the high frequency region and by the CSA wavelength scaled aperture 100. The separation, or distance, between adjacent high frequency unit cells 115 within each high frequency current sheet sub-array 110 can be constant, e.g., equal to $$\frac{\lambda_{high}}{2}.$$

The medium frequency region can include a plurality of medium frequency current sheet sub-arrays 120 arranged around the high frequency sub-array(s) 110. Each medium frequency sub-array 120 includes a respective plurality of medium frequency cell units 125. The medium frequency unit cells 125 of various medium frequency sub-arrays 120 can be identical with respect to each other for example. For instance, the medium frequency unit cells 125 can share a common shape and a common size. A dimension (e.g., width, length, or other dimension) of the medium frequency unit cells 125 can be equal to (or slightly larger than)

$$\frac{\lambda_{med}}{2}.$$

The parameter $\lambda_{med}$ represents the shortest wavelength supported by the medium frequency region. The wavelength $\lambda_{med}$ corresponds to the highest frequency $f_{med}$ supported by the medium frequency region. As such, the medium frequency region (or the medium frequency sub-arrays 120) support a frequency bandwidth $[f_0, f_{med}]$, where $f_{med} < f_{high}$. Accordingly, the bandwidth $[f_0, f_{med}]$ supported by the medium frequency region is a subset of the bandwidth $[f_0, f_{high}]$ supported by the high frequency region. The separation, or distance, between adjacent medium frequency unit cells 125 within each medium frequency current sheet sub-array 120 can be constant, e.g., equal to $$\frac{\lambda_{med}}{2}.$$

The low frequency region includes a plurality of low frequency current sheet sub-arrays 130 arranged around the medium frequency region. Each low frequency current sheet sub-array 130 includes a respective plurality low frequency unit cells 135. The low frequency unit cells 135 of various low frequency sub-arrays 130 can be identical with respect to one another. For instance, the low frequency unit cells 135 can share a common shape and a common size. A dimension (e.g., width, length, or other dimension) of the low frequency unit cells 135 can be equal to (or slightly larger than)

$$\frac{\lambda_{low}}{2}.$$

The parameter $\Delta_{low}$ represents the shortest wavelength supported by the low frequency region. The wavelength $\lambda_{low}$ corresponds to the highest frequency $f_{low}$ supported by the medium frequency region. As such, the low frequency region (or the low frequency current sheet sub-arrays 130) support a frequency bandwidth $[f_0, f_{low}]$, where $f_{low} < f_{med}$. Accordingly, the bandwidth $[f_0, f_{low}]$ supported by the low frequency region is a subset of the bandwidth $[f_0, f_{med}]$ supported by the medium frequency region. The separation, or distance, between adjacent low frequency unit cells 135 within each high frequency current sheet sub-array 130 can be constant, e.g., equal to $$\frac{\lambda_{low}}{2}.$$

The CSA wavelength scaled aperture 100 can utilize the low, medium and high frequency regions together as a full UWB aperture to realize a constant beam width across a very large IBW. The high, medium, and low frequency unit cells 115, 125 and 135 can be steerable together to achieve a signal beam associated with a desired lookup angle. In some embodiments, the high, medium, and low frequency unit cells 115, 125 and 135 can be independently steerable (e.g., pointed to separate lookup angles) to form multiple signal beams. For instance, the unit cells in each sub-array (such as a high frequency sub-array 110, medium frequency sub-array 120, or low frequency sub-array 130) can be steered to form a respective transmit/receive signal beam. In some instances, the sub-arrays associated with each region (such as the high frequency region, the medium frequency region, or the low frequency region) can be steered to form a respective transmit/receive signal beam. The CSA wavelength scaled aperture 100 can be viewed as a modular structure. In particular, the modular structure of the CSA wavelength scaled aperture 100 allows for efficient and relatively simplified construction of large scale AESA aperture for a large IBW, as various frequency regions or various frequency sub-arrays can be designed or constructed separately.

In the CSA wavelength scaled aperture 100, the high, medium, and low frequency unit cells 115, 125 and 135 can all have the same shape, such as a crossed dipole shape, square dipole shape, linear dipole shape, octagonal ring shape, hexagonal ring shape, or other shape. Linear dipoles can be parallel dipoles arranged horizontally or vertically. While crossed dipoles can allow for dual polarization, linear dipoles support only linear polarization. In some embodiments, the unit cells associated with different frequency regions can have distinct shapes.

The CSA wavelength scaled aperture 100 can efficiently and reliably support an ultra-ultra-wide band. The frequency bandwidth $[f_0, f_{high}]$ supported by the CSA wavelength scaled aperture 100 can realize a large IBW centered anywhere within the frequency range between 200 MHz and 60 GHz, or can even extend beyond 60 GHz. The CSA wavelength scaled aperture 100 can support an instantaneous bandwidth (IBW) with a respective ratio equal to or exceeding 20:1. The various frequency regions preclude excessive lattice spacing densities. Specifically, the spacing between adjacent unit cells in the medium frequency region and the low frequency region can be substantially larger than the spacing between adjacent unit cells in the high frequency region. Furthermore, the use of various frequency regions can help avoid oversampling of relatively low frequency signals. For example, signals associated with the low or medium frequency regions can be sampled at a relatively low sampling rate than signals associated with only the high frequency region.

Existing CSAs usually suffer from grating lobes, unless the entire aperture is half wave sampled at the highest frequency of operation (e.g., the spacing between adjacent unit cells is equal to half the wavelength at the highest frequency of operation). The CSA scaled wavelength aperture 100, using multiple frequency regions (or distinct frequency sub-arrays) with distinct spacing between adjacent unit cells, can lead to an antenna performance with no grating lobes over at least a ±60° conical scan volume without oversampling the aperture (e.g., without necessarily enforcing a spacing between all adjacent unit cells equal to half the wavelength at the highest frequency of operation). In particular, when accumulating beams associated with various frequency regions (or various frequency sub-arrays), the variation in spacing between adjacent unit cells from one frequency region to another can lead to a relatively wide conical scan volume (e.g., with ±60° angle or even wider). In designing the CSA wavelength scaled aperture 100 (e.g., as part of constructing an AESA antenna), parameters such as the number of frequency regions, the geometry and relative placement of various geometry regions, the number and size(s) of sub-arrays in each frequency region, the number and size of unit cells in each frequency current sheet sub-array, and the spacing between adjacent unit cells in each frequency current sheet sub-array can be selected to achieve a desired frequency band or a desired grating lobe free conical scan volume.

The CSA wavelength scaled aperture 100 shown in FIG. 1 represents only a single illustrative implementation. Other implementations of the CSA wavelength scaled aperture 100 are contemplated by the current disclosure. For example, the CSA wavelength scaled aperture 100 can include more than (or less than) three frequency regions. Also, each frequency region can include any number of current sheet sub-arrays. Furthermore, the frequency regions can be arranged according to various configurations. For example, the various frequency regions can be arranged adjacent to each other, but not in an endocentric configuration. In addition, each frequency sheet current sub-array (such as sub-arrays 110, 120, and 130) can include any number of respective unit cells. In some embodiments, each frequency sheet current sub-array can be implemented on a separate printed circuit board (PCB). According to other embodiments, each frequency region can be implemented on a separate PCB. In yet other embodiments, multiple frequency regions, or the whole the CSA wavelength scaled aperture 100, can be implemented on a single PCB.

Figure 2:
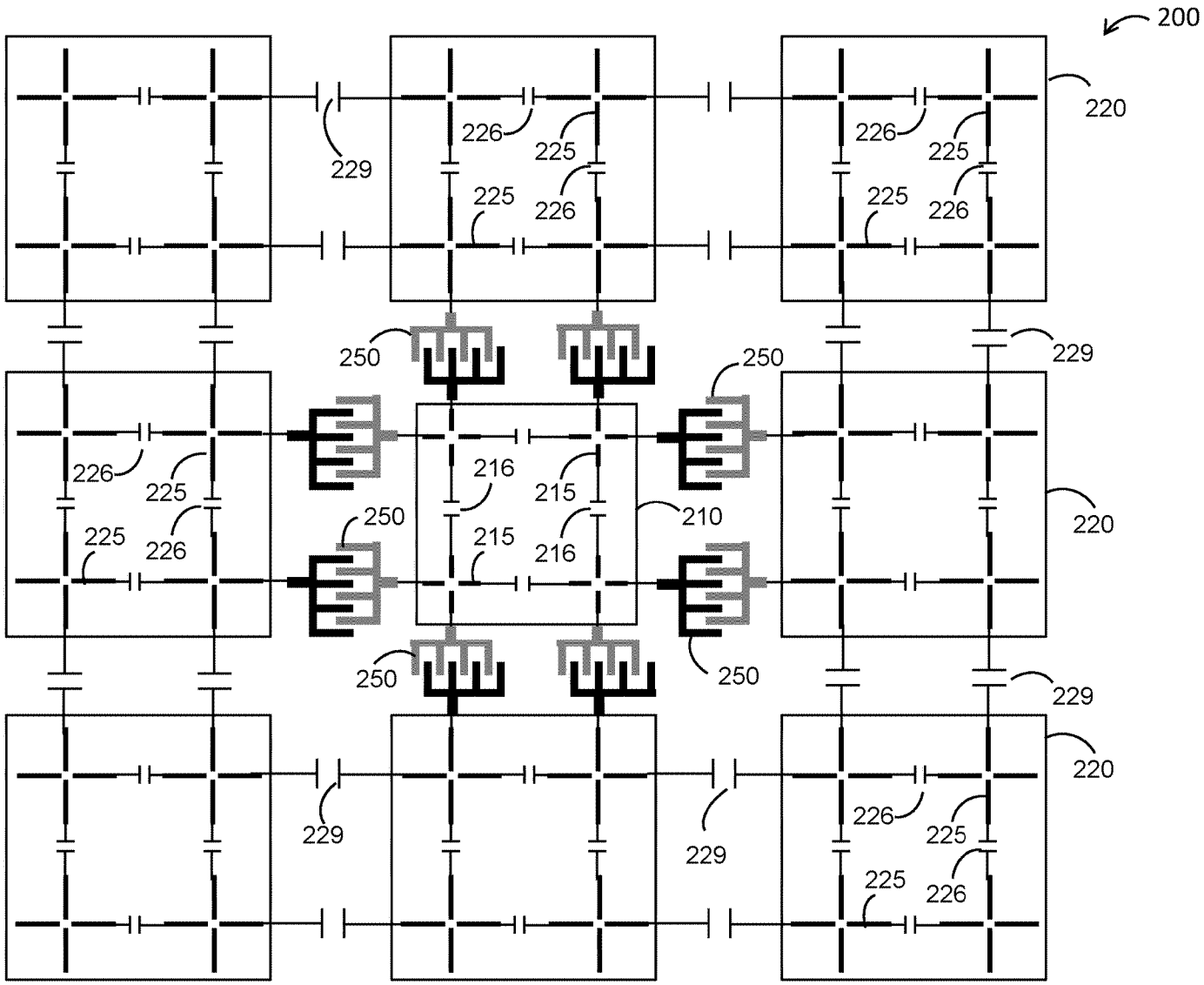
FIG. 2 shows a diagram of a CSA wavelength scaled aperture employing crossed dipoles, according to embodiments of the inventive concepts disclosed herein.

With reference to FIG. 2, a CSA wavelength scaled aperture 200 (or a portion thereof) employing crossed dipoles is illustrated. The CSA wavelength scaled aperture 200 includes a high frequency region having a high frequency current sheet sub-array 210 and a medium frequency region having a plurality of medium frequency current sheet sub-arrays 220. The high frequency current sheet sub-array 210 includes a plurality of crossed dipoles 215 coupled to each other via respective capacitors 216. Each medium frequency current sheet sub-array 220 includes a plurality of crossed dipoles 225 tightly coupled to each other via respective capacitors 226. The CSA wavelength scaled aperture 200 also includes capacitors 229 coupling adjacent dipoles from separate medium frequency current sheet sub-arrays 220, and capacitors 250 coupling adjacent dipoles from separate frequency regions.

The various current sheet sub-arrays (such as sub-arrays 210 and 220) can include crossed diploes (such as crossed dipoles 215 and 225) configured to act as radiating elements (or antenna elements). Each crossed dipole includes a vertical dipole element and a horizontal dipole element. The vertical and horizontal elements allow for supporting (e.g., transmitting or receiving) dual linear or circularly polarized waves. The size of the horizontal and vertical dipole elements in the high frequency current sheet sub-array 210 can be substantially smaller than the size of the horizontal and vertical dipole elements in the medium frequency current sheet sub-arrays 210. The CSA wavelength scaled aperture 200 can include a low frequency region having a plurality of low frequency current sheet sub-arrays (not shown in FIG. 2) arranged around the medium frequency current sheet sub-arrays 220. Each low frequency current sheet sub-array can include a respective plurality of low frequency crossed dipoles (e.g., similar to the crossed dipoles 215 and 225 but with larger elements' size(s)).

In the high frequency current sheet sub-array, adjacent vertical elements associated with separate dipoles 215 can be coupled to each other via capacitors 216, and adjacent horizontal elements associated with separate dipoles 215 are coupled to each other via capacitors 216. Also, adjacent vertical dipole elements and adjacent horizontal dipole elements associated with separate dipoles 225, in a medium frequency current sheet sub-array 220, can be coupled to each other via capacitors 226. The capacitors 216 can be implemented, within the PCB embedding the high frequency current sheet sub-array 210, as interdigitated capacitors. The capacitors 226 can be implemented, within the PCB embedding a respective medium frequency current sheet sub-array 220, as interdigitated capacitors. The capacitance associated with interdigitated capacitors can be increased by increasing the length of the respective fingers. Adjacent horizontal elements and adjacent vertical elements of low frequency crossed dipoles within a given low frequency current sheet sub-array (not shown in FIG. 2) can be coupled via capacitors similar capacitors 216 and 226.

Adjacent (vertical or horizontal) dipole elements associated with dipoles 225 within separate medium frequency current sheet sub-arrays 220 are coupled to each other via capacitors 229. Similar capacitors can connect adjacent (vertical or horizontal) dipole elements associated with crossed dipoles located in separate high frequency current sheet sub-arrays 210 (if there is more than one), or adjacent (vertical or horizontal) dipole elements associated with crossed dipoles located in separate low frequency current sheet sub-arrays (not shown in FIG. 2). If sub-arrays within a given frequency region are implemented on a single PCB, the capacitors 229 (and similar capacitors) connecting crossed dipoles in separate sub-arrays of a given frequency region can be implemented as printed capacitors (e.g., interdigitated capacitors) within the PCB. The capacitors 229 (and similar capacitors) connecting crossed dipoles in separate sub-arrays of a given frequency region can be any type of capacitors separate from the PCB.

Adjacent (horizontal or vertical) dipole elements associated with distinct frequency regions are coupled via capacitors 250. For instance, capacitors 250 connect dipole elements in the high frequency current sheet sub-array 210 to adjacent dipole elements in the medium frequency current sheet sub-arrays 220. Similar capacitors (not shown in FIG. 2) can connect dipole elements in the medium frequency current sheet sub-arrays 220 to adjacent dipole elements in low frequency current sheet sub-arrays (not shown in FIG. 2). The capacitors 250 (and, in general, capacitors coupling crossed dipoles across distinct frequency regions) can be interdigitated and printed on the same (PCB) layer as the dipoles. For example, if the CSA scaled wavelength aperture 200 is implemented on a single PCB, the capacitors 250 can be printed on that PCB. Also, even if different frequency regions (or different sub-arrays) are implemented on separate PCBs, a capacitor 250 coupling dipoles across a pair PCBs can be printed on of the pair of PCBs.

The capacitors 250 can be active electronic variable capacitors (e.g., using diodes or transistors) to allow for electronic tuning of the respective capacitance. As such, the capacitors 250 can be implemented on the same PCB layer, or a different PCB layer, than the layer on which the crossed dipoles (or the radiating elements in general) are printed. The capacitors 250 can be lumped passive capacitors that are metallurgically connected to the crossed dipoles (or the radiating elements). The capacitors 250 can also be implemented as passive capacitors embedded in one or more PCB layers below the layer on which the radiating elements are implemented. The capacitors 250 can be implemented as electronic capacitive structures as a part of a custom radio frequency integrated circuit (RFIC) that includes the transmit/receive modules (TRM)s.

While the radiating elements of the CSA wavelength scaled aperture 200 are illustrated as crossed dipoles, such illustration represents only a possible implementation. Other implementations, for example, where the radiating elements include linear dipoles, square dipoles, octagonal rings, hexagonal rings, or elements of other shapes compatible with the CSA wavelength scaled array architecture are also contemplated by the current disclosure. The capacitive coupling discussed with regard to FIG. 2 can also apply to other radiating elements (other than crossed dipoles) regardless of their respective shape.

Figure 3:
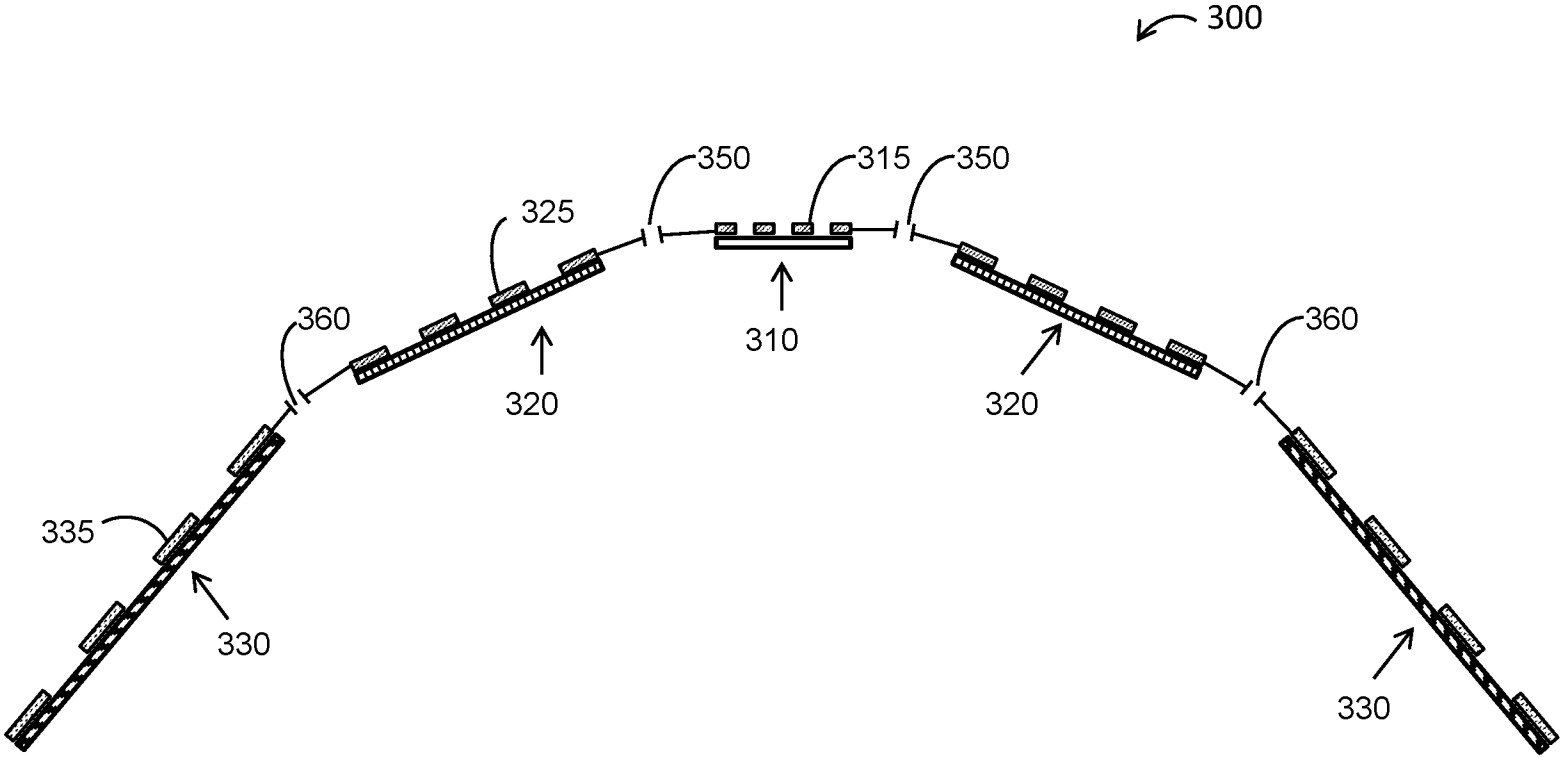
FIG. 3 shows a diagram illustrating a non-planar configuration of a CSA wavelength scaled aperture, according to embodiments of the inventive concepts disclosed herein.

Referring to FIG. 3, a non-planar configuration of a CSA wavelength scaled aperture 300 is illustrated. The CSA wavelength scaled aperture 300 includes at least one high frequency current sheet sub-array 310, a plurality of medium frequency current sheet sub-arrays 320, and a plurality of low frequency current sheet sub-array 330. In some embodiments, all of the subarrays 310, 320, and 330 can have the same frequency band. Such embodiments would lead to a classic, uniform lattice density CSA, but in a non-planar (conformal) manner.

The high frequency current sheet sub-array 310 includes a respective plurality of high frequency current sheet radiating elements 315, each medium frequency current sheet sub-array 320 includes a respective plurality of medium frequency current sheet radiating elements 325, and each low frequency current sheet sub-array 330 includes a respective plurality of low frequency current sheet radiating elements 335. The medium frequency current sheet sub-arrays 320 can be arranged at an angle with respect to adjacent high frequency current sheet sub-array(s) 310. Also, the low frequency current sheet sub-arrays 330 can be arranged at an angle with respect to adjacent medium frequency current sheet sub-array(s) 320. In some implementations, even adjacent sub-arrays within a given frequency region can be arranged at an angle with respect to each other. The non-planar arrangement of current sheet sub-arrays allows for a non-planar configuration of the CSA wavelength scaled aperture 300. In particular, the number and size of current sheet sub-arrays in each frequency region and the tilt angles between various adjacent current sheet sub-arrays can be designed (or selected) to accommodate a given curved or non-planar deployment platform surface on which the CSA wavelength scaled aperture 300 is to be mounted. The tilting of the sub-arrays can also be in three dimensional so that the CSA wavelength scaled aperture 300 can conform to arbitrary doubly curved surfaces (e.g., a spherical surface).

High frequency current sheet radiating elements 315 are coupled to adjacent medium frequency current sheet radiating elements 325 via capacitors 350. Also, medium frequency current sheet radiating elements 325 are coupled to adjacent low frequency current sheet radiating elements 335 via capacitors 360. The capacitors 350 and 360 can be non-planar capacitors. Capacitors (such as capacitors 229 of FIG. 2) coupling radiating elements from separate sub-arrays within a given frequency region are not shown in FIG. 3. Such capacitors can also be non-planar capacitors.

Figure 4:
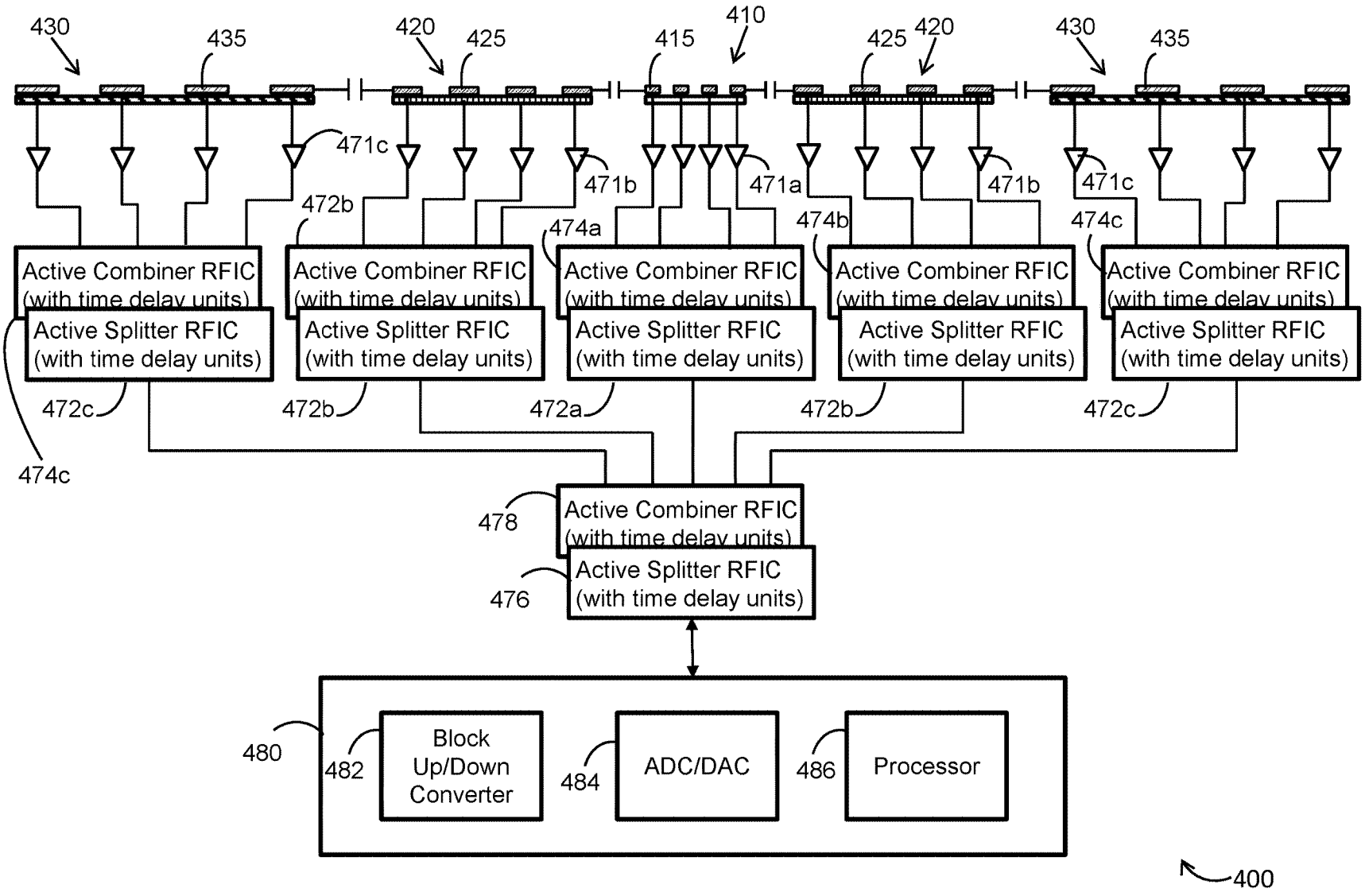
FIG. 4 is a diagram illustrating an active electronically scanned array (AESA) system employing a CSA wavelength scaled aperture, according to embodiments of the inventive concepts disclosed herein.

Referring to FIG. 4, an active electronically scanned array (AESA) system 400 employing a CSA wavelength scaled aperture is illustrated. The AESA system 400 includes CSA wavelength scaled aperture having at least one high frequency current sheet sub-array 410, a plurality of medium frequency current sheet sub-arrays 420, and a plurality of low frequency current sheet sub-arrays 430. The AESA system 400 also includes a plurality of amplifiers 471*a-c*, a plurality of active splitter Radio Frequency Integrated Circuits (RFICs) 472*a-c* and 476, a plurality active combiner RFICs 474*a-c* and 478, and a transceiver 480.

The AESA system 400 can operate according to a (RX) receive mode or a transmit (TX) mode. In the RX mode, the AESA system 400 employs the active combiner RFICs 474*a-c* and 478, whereas in the TX mode, the AESA system 400 employs the active splitter RFICs 472*a-c* and 476. In FIG. 4, only the RF amplifiers associated with the RX mode (coupled to active combiner RFICs 474*a-c*) are shown. The AESA system 400 includes a second set of RF amplifiers (not shown in FIG. 4) coupling the radiating elements 415, 425 and 435 to the active splitter RFICs 472*a-c*. In some embodiments, the active splitter RFICs 472*a-c* can be bidirectional, e.g., acting both as slitters and combiners. In such embodiments, the number of active splitter/combiner RFICs would be reduced by a factor of two. In some embodiments, the RFICs can be configured as half-duplex by means of respective transmit/receive switches in the vicinity of each radiating element port of the AESA aperture. In some embodiments, the RFICs can be configured as full duplex operation with a miniature duplexer associated with every radiating element. Alternatively, the AESA system 400 can include two separate CSA wavelength scaled apertures, e.g., a RX aperture and a TX aperture.

The high frequency current sheet radiating elements 415 in each high frequency current sheet sub-array 410 can be coupled via respective RF amplifiers 471*a* to one or more active splitter RFICs 472*a*, and/or one or more active combiner RFICs 474*a*. Each active combiner RFIC 474*a* can include a plurality of time delay units. Each active combiner RFIC 474*a* also can include respective RF amplifiers (or can be associated with amplification gains). Each high frequency current sheet radiating elements 415 can be associated with a respective pair of a time delay unit (in the active combiner RFIC(s) 474*a*) and a RF amplifier 471*a*. Signals received via the high frequency current sheet radiating elements 415 can be amplified (by the RF amplifiers 471*a*), time-delayed by the time delay units in the active combiner RFIC 474*a*, and accumulated by the same active combiner RFIC 474*a*. As such, the active combiner RFIC 474*a* can generate a single output signal based on multiple RF signals received by the high frequency current sheet radiating elements 415. The AESA system 400 can include a single active combiner RFIC 474*a*, or multiple active combiner RFICs 474*a* (e.g., each active combiner RFIC 474*a* associated with a respective high frequency current sheet sub-array 410 or associated with a respective subset of high frequency current sheet radiating elements 415).

The active splitter RFIC(s) 472*a* can receive a signal to be transmitted by the high frequency current sheet radiating elements 415 and split the received signal into multiple signals. Each high frequency current sheet radiating elements 415 can be associated with a respective pair of time delay unit (in the active combiner RFIC(s) 474*a*) and a RF amplifier (not shown in FIG. 4) coupling the high frequency current sheet radiating elements 415 to active splitter RFIC 472*a*. The multiple split signals can then be time-delayed by the time delay units in the active splitter RFIC 472*a* and amplified by the RF amplifiers (not shown in FIG. 4) coupling the active splitter RFIC(s) 472*a* to high frequency current sheet radiating elements 415 before sending each split signal to a respective high frequency current sheet radiating elements 415. The AESA system 400 can include a single active splitter RFIC 472*a*, or multiple active splitter RFICs 472*a* (e.g., each active splitter RFIC 474*a* associated with a respective high frequency current sheet sub-array 410 or associated with a respective subset of high frequency current sheet radiating elements 415).

The RF amplifiers 471*b*, the active splitter RFIC(s) 472*b*, and the active combiner RFIC(s) 472*b* associated with the medium frequency current sheet sub-arrays 420 are functionally analogous to the RF amplifiers 471*a*, the active splitter RFIC(s) 472*a*, and the active combiner RFIC(s) 472*a*, respectively. In particular, the RF amplifiers 471*b*, amplifiers coupling the active splitter RFIC(s) 472*b* to the medium frequency current sheet radiation elements 425 (not shown in FIG. 4), the active splitter RFIC(s) 472*b*, and the active combiner RFIC(s) 472*b* operate on signals associated with the medium frequency current sheet radiation elements 425 in a similar way as the RF amplifiers 471*a*, amplifiers coupling the active splitter RFIC(s) 472*a* to the high frequency current sheet radiation elements 415 (not shown in FIG. 4), the active splitter RFIC(s) 472*a*, and the active combiner RFIC(s) 472*a* operate on signals associated with the high frequency current sheet radiation elements 415. The AESA system 400 can include a single active combiner RFIC 474*b*, or multiple active combiner RFICs 474*b* (e.g., each active combiner RFIC 474*b* associated with a respective medium frequency current sheet sub-array 420 or associated with a respective subset of medium frequency current sheet radiating elements 425). The AESA system 400 can include a single active splitter RFIC 472*b*, or multiple active splitter RFICs 472*b* (e.g., each active splitter RFIC 472*b* associated with a respective medium frequency current sheet sub-array 420 or associated with a respective subset of medium frequency current sheet radiating elements 425).

The RF amplifiers 471*c*, amplifiers coupling the active splitter RFIC(s) 472*c* to the low frequency current sheet radiation elements 435 (not shown in FIG. 4), the active splitter RFIC(s) 472*c*, and the active combiner RFIC(s) 472*c* associated with the low frequency current sheet sub-arrays 430 are functionally analogous to the RF amplifiers 471*a*, amplifiers coupling the active splitter RFIC(s) 472*a* to the high frequency current sheet radiation elements 415 (not shown in FIG. 4), the active splitter RFIC(s) 472*a*, and the active combiner RFIC(s) 472*a*, respectively. In particular, the RF amplifiers 471*c*, amplifiers coupling the active splitter RFIC(s) 472*c* to the low frequency current sheet radiation elements 435 (not shown in FIG. 4), the active splitter RFIC(s) 472*c*, and the active combiner RFIC(s) 472*c* operate on signals associated with the low frequency current sheet radiation elements 435 in a similar way as the RF amplifiers 471*a* amplifiers coupling the active splitter RFIC(s) 472*a* to the high frequency current sheet radiation elements 415 (not shown in FIG. 4)—the active splitter RFIC(s) 472*a*, and the active combiner RFIC(s) 472*a* operate on signals associated with the high frequency current sheet radiation elements 415.

The AESA system 400 can include a single active combiner RFIC 474*c*, or multiple active combiner RFICs 474*c* (e.g., each active combiner RFIC 474*c* associated with a respective low frequency current sheet sub-array 430 or associated with a respective subset of low frequency current sheet radiating elements 435). The AESA system 400 can include a single active splitter RFIC 472*c*, or multiple active splitter RFICs 472*c* (e.g., each active splitter RFIC 472*c* associated with a respective low frequency current sheet sub-array 430 or associated with a respective subset of low frequency current sheet radiating elements 435). In some embodiments, any of the active combiner RFICs 427*a-c* and/or the active slitter RFICs 427*a-c* can be associated (or coupled to) radiating elements across distinct sub-arrays (or across different frequency regions.

In the TX mode, the active splitter RFIC 476 can be configured to receive a signal from the transceiver 480 and split the received signal into multiple split signals, and time delay the split signals via the time delay units in the active splitter RFIC 476. The active splitter RFIC 476 can transmit each time delayed split signal to one of the active splitter RFICs 472*a-c*. In the RX mode, the active combiner RFIC 478 can be configured to receive multiple signals from the active combiner RFICs 474*a-c*, time delay each of the received signals, and accumulate the time delayed signals into a single output signal that is transmitted to the transceiver 480. The AESA system 400 can include more than one active combiner RFIC 478 and/or more than one active splitter RFIC 476. When employing multiple active combiner RFICs 478 and/or multiple active splitter RFIC 476, the AESA system 400 can be configured to create multiple, independently steered AESA beams. The use of active combiner/splitter networks negate the need for physically large and bulky passive transmission line feed manifolds. Since parallel banks of feed manifolds are usually employed for independently steered, multi-beam operation, the passive transmission line feed approach becomes impractical as the number of radiation beams increases and exceeds a few. The drastic feed manifold miniaturization of the RFIC splitter/combiners makes multiple, independently steered UWB AESA radiation beams feasible.

The transceiver 480 can include a block up/down converter 482, an analog-to-digital converter/digital-to-analog converter (ADC/DAC) 484, and a processor 486. The block up/down converter 482 can up convert signals destined for the CSA wavelength scalable aperture to a higher frequency band and down convert RF signals received from the active combiner RFIC 478 to a base band. The ADC/DAC 484 can convert analog base signals output by the block up/down converter 482 to corresponding digital signals or can convert digital signals received from the processor 486 to corresponding analog signals. The processor 486 can be configured to control the CSA wavelength scalable aperture, for example, by switching the CSA wavelength scalable aperture between different modes (e.g., receiving or transmitting modes). The processor 482 can also be configured to adjust amplification parameters of the RF amplifiers 471*a-c* and time-shift parameters of the time delay units associated with the active splitter RFICs 472*a-c* and 476 and the active combiner RFICs 474*a-c* and 478. Specifically, depending on the direction to which the CSA wavelength scalable aperture is to be steered, the processor 486 can determine amplification coefficient(s) for one or more of the RF amplifiers 471*a-c*, and determine time shift coefficient(s) for one or more time delay units associated with of the active splitter RFICs 472*a-c* and 476 (or the active combiner RFICs 474*a-c* and 478). The active splitter/combiners shown in FIG. 4 can also be realized to incorporate variable gain to place a power taper across the array for low side lobe radiation patterns and null forming for Anti-Jam operation. Processor 486 can control the gain adjustment within the active splitter/combiner RFICs. The processor 486 can then cause the one or more RF amplifiers to adjust their respective amplification parameter(s) according to the determined amplification coefficient(s). The processor 486 can also cause the one or more one time delay units (or respective active splitter/combiner RFIC(s)) to adjust respective time shift parameter(s) according to the determined time shift coefficient(s).

The processor 486 can be configured to determine which current sheet sub-array to be active (e.g., actively transmitting or receiving signals) when transmitting or receiving a RF signal. For instance, if the frequency band of the RF signal is within the frequency band supported by the low frequency current sheet sub-arrays 430, all radiating elements in the CSA wavelength scaled aperture are active. If the frequency band of the RF signal is not within the frequency band supported by the low frequency current sheet sub-arrays 430 but is within the frequency band supported by the medium frequency current sheet sub-arrays 420, the medium frequency current sheet sub-arrays 420 and the high frequency current sheet sub-arrays 410 (but not the low frequency current sheet sub-arrays 430) are active. If the frequency band of the RF signal is not within the frequency band supported by the medium frequency current sheet sub-arrays 420 but is within the frequency band supported by the high frequency current sheet sub-arrays 410, only the high frequency current sheet sub-arrays 410 are active, whereas the other sub-arrays 420 and 430 are not receiving or transmitting the RF signal.

The AESA architecture shown in FIG. 4 creates sub-banded signal combining within the AESA feed network. Alternatively, the Active Slitter/combiner RFICs can be made broad band such that the high frequency, medium frequency, and/or low frequency sub-arrays, for example, can share common RFIC splitter networks.

The RF amplifier(s) and the time delay unit(s) associated with each current sheet radiating element can be viewed as forming a transmit/receive module associated with that current sheet radiating element. In some embodiments, separate TRMs associated with separate current sheet radiating elements can be implemented separate electronic components. The active electronically scanned array (AESA) system 400 shown in FIG. 4 represents a possible (but non-limiting) implementation, and other implementation are contemplated by the current disclosure. For example, phase shifters can be used instead of the time delay units.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the broad scope of the inventive concepts disclosed herein.

The present disclosure contemplates methods, systems and program products on any machine-readable media for accomplishing various operations. Embodiments of the inventive concepts disclosed herein may be implemented using existing computer operational flows, or by a special purpose computer operational flows for an appropriate system, incorporated for this or another purpose, or by a hardwired system. Embodiments within the scope of the inventive concepts disclosed herein include program products comprising machine-readable media for carrying or having machine-executable instructions or data structures stored thereon. Such machine-readable media can be any available media that can be accessed by a special purpose computer or other machine with an operational flow. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with an operational flow. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a special purpose computer, or special purpose operational flowing machines to perform a certain function or group of functions.

What is claimed is:

1. An antenna array system comprising:

a high frequency sub-array including a plurality of first unit cells scaled to support a first operating frequency band having a respective maximum operating frequency f1, the first operating frequency band representing a full operating frequency band of the antenna array system;

one or more low frequency sub-arrays arranged adjacent to the high frequency sub-array, each low frequency sub-array including a respective plurality of second unit cells scaled to support a second operating frequency band having a respective maximum operating frequency f2 smaller than f1;

one or more capacitors each coupled to a respective first unit cell of the high frequency sub-array and a respective second unit cell of the one or more low frequency sub-arrays; and a processor for controlling operational parameters associated with the plurality of first unit cells and the pluralities of second unit cells.

2. The antenna array system of claim 1 further comprising a plurality of transmit/receive modules (TRMs), each TRM associated with a respective first unit cell or a respective second unit cell.

3. The antenna array system of claim 1 further comprising a plurality of time delay units, each time delay unit associated with a respective first unit cell or a respective second unit cell.

4. The antenna array system of claim 1, wherein the high frequency sub-array and the one or more low frequency sub-arrays are arranged according to a non-planar configuration.

5. The antenna array system of claim 4, wherein the one or more capacitors include non-planar capacitors.

6. The antenna array system of claim 1, wherein the one or more capacitors include interdigitated capacitors.

7. The antenna array system of claim 1, wherein the one or more capacitors include active electronic variable capacitors.

8. The antenna array system of claim 1, wherein the one or more capacitors include a lumped passive capacitor metallurgically coupled to the respective first unit cell and the respective second unit cell.

9. The antenna array system of claim 1, wherein the plurality of first unit cells and the pluralities of second unit cells include crossed dipoles.

10. The antenna array system of claim 1, wherein the processor is configured to activate at least one of the high frequency sub-array or the one or more low frequency sub-arrays for receiving or transmitting a radio signal.

11. The antenna array system of claim 1, wherein the high frequency sub-array is associated with a separate corresponding printed circuit board (PCB).

12. The antenna array system of claim 1, wherein each of the one or more low frequency sub-arrays is associated with a separate corresponding printed circuit board (PCB).

13. A current sheet array wavelength scaled antenna aperture comprising:

a high frequency sub-array including a plurality of first unit cells scaled to support a first operating frequency band having a respective maximum operating frequency f1, the first operating frequency band representing a full operating frequency band of the current sheet array wavelength scaled antenna aperture;

one or more low frequency sub-arrays arranged adjacent to the high frequency sub-array, each low frequency sub-array including a respective plurality of second unit cells scaled to support a second operating frequency band having a respective maximum operating frequency f2 smaller than f1; and one or more capacitors each of which coupled to a respective first unit cell of the high frequency sub-array and a respective second unit cell of the one or more low frequency sub-arrays.

14. The current sheet array wavelength scaled antenna aperture of claim 13, wherein the high frequency sub-array and the one or more low frequency sub-arrays are arranged according to a non-planar configuration.

15. The current sheet array wavelength scaled antenna aperture of claim 14, wherein the one or more capacitors include non-planar capacitors.

16. The current sheet array wavelength scaled antenna aperture of claim 13, wherein the one or more capacitors include interdigitated capacitors.

17. The current sheet array wavelength scaled antenna aperture of claim 13, wherein the one or more capacitors include active electronic variable capacitors.

18. The current sheet array wavelength scaled antenna aperture of claim 13, wherein the one or more capacitors include a lumped passive capacitor metallurgically coupled to the respective first unit cell and the respective second unit cell.

19. The current sheet array wavelength scaled antenna aperture of claim 13, wherein the plurality of first unit cells and the one or more pluralities of second unit cells include crossed dipoles.

20. A method of providing an antenna array, the method comprising:

providing a high frequency sub-array including a plurality of first unit cells scaled to support a first operating frequency band having a respective maximum operating frequency f1, the first operating frequency band representing a full operating frequency band of the antenna array;

arranging a plurality of low frequency sub-arrays adjacent to the high frequency sub-array, each low frequency sub-array including a respective plurality of second unit cells scaled to support a second operating frequency band having a respective maximum operating frequency f2 smaller than f1; and coupling each of one or more first capacitors to a respective first unit cell of the high frequency sub-array and a respective second unit cell of the low frequency sub-arrays.

* * * * *